US009102068B2

(12) United States Patent
Gringer et al.

(10) Patent No.: US 9,102,068 B2
(45) Date of Patent: Aug. 11, 2015

(54) MULTIFUNCTION SAFETY KNIFE

(71) Applicant: ALLWAY TOOLS, INC., Bronx, NY (US)

(72) Inventors: Donald Gringer, New York, NY (US); Yuan Fang Cheng, Forest Hills, NY (US)

(73) Assignee: ALLWAY TOOLS, INC., Bronx, NY (US)

( * ) Notice: Subject to any disclaimer, the term of this patent is extended or adjusted under 35 U.S.C. 154(b) by 134 days.

(21) Appl. No.: 14/087,166

(22) Filed: Nov. 22, 2013

(65) Prior Publication Data

US 2014/0075762 A1 Mar. 20, 2014

Related U.S. Application Data

(63) Continuation-in-part of application No. 13/468,868, filed on May 10, 2012, now abandoned.

(51) Int. Cl.
*B26B 1/08* (2006.01)
*B26B 5/00* (2006.01)

(52) U.S. Cl.
CPC . *B26B 1/08* (2013.01); *B26B 5/001* (2013.01); *B26B 5/003* (2013.01); *B26B 5/005* (2013.01)

(58) Field of Classification Search
None
See application file for complete search history.

(56) References Cited

U.S. PATENT DOCUMENTS 2,274,799 A * 3/1942 Kroemer ..... 30/2
2,593,601 A * 4/1952 Pollak ..... 30/2
2,882,598 A * 4/1959 Fidelman ..... 30/294
D249,325 S 9/1978 Rollband
4,167,810 A * 9/1979 Gilbert ..... 30/2
4,242,795 A 1/1981 Rollband
D294,797 S 3/1988 Itoh
4,791,725 A * 12/1988 Amagaya ..... 30/154
D323,967 S 2/1992 Talbot
D329,584 S 9/1992 Shevin et al.
5,282,316 A * 2/1994 Anderson ..... 30/294
5,522,135 A 6/1996 Votolato
5,581,893 A 12/1996 Ouellette
D377,595 S 1/1997 Wiezenthal
5,613,300 A 3/1997 Schmidt
D381,886 S 8/1997 Domenico
5,697,157 A 12/1997 Votolato
5,720,062 A 2/1998 Vaught
5,765,288 A * 6/1998 Hagler, Jr. ..... 30/280
5,768,787 A * 6/1998 Ireland ..... 30/294
5,794,350 A * 8/1998 Shand ..... 30/294
5,813,121 A 9/1998 Gringer
5,819,419 A 10/1998 Schmidt
5,829,321 A 11/1998 Domenico (Continued)

OTHER PUBLICATIONS

Better Tools Full Line Catalog, www.better-tools.com, 2007.

(Continued)

*Primary Examiner* — Sean Michalski
(74) *Attorney, Agent, or Firm* — Gottlieb, Rackman & Reisman, P.C.

(57) ABSTRACT

There is provided in a preferred embodiment of the present invention a multifunction safety knife having two cutting positions. The knife includes a head having a protected lower opening and a frontal opening. A bottom cutting edge of a blade is exposed by the protected lower opening and a front cutting edge of the blade is selectively exposed by the frontal opening. The head further includes a pointed hook for puncturing film prior to cutting a length of it.

14 Claims, 7 Drawing Sheets

(56) References Cited

U.S. PATENT DOCUMENTS

| | | | | |
|---|---|---|---|---|
| 5,852,874 | A | 12/1998 | Walker | |
| 5,890,290 | A | 4/1999 | Davis | |
| 6,003,181 | A | 12/1999 | Wenk | |
| D421,889 | S | 3/2000 | Moore | |
| 6,035,534 | A | 3/2000 | Abbott | |
| 6,044,562 | A | 4/2000 | Dillenbeck | |
| 6,070,326 | A | 6/2000 | Berns | |
| 6,178,640 | B1 | 1/2001 | Votolato | |
| D439,493 | S | 3/2001 | Chen | |
| 6,367,154 | B2 * | 4/2002 | Degabli | 30/123 |
| 6,446,340 | B1 | 9/2002 | Ping | |
| 6,502,311 | B1 | 1/2003 | Khachatoorian et al. | |
| 6,516,520 | B1 * | 2/2003 | Liao | 30/162 |
| 6,578,266 | B2 | 6/2003 | Chomiak | |
| 6,637,112 | B2 | 10/2003 | Davis | |
| D481,609 | S | 11/2003 | Perlmutter et al. | |
| D498,404 | S | 11/2004 | Schmidt | |
| 6,857,192 | B1 * | 2/2005 | Summers et al. | 30/294 |
| D521,844 | S | 5/2006 | Kempker et al. | |
| D527,604 | S | 9/2006 | Kempker et al. | |
| 7,305,770 | B2 | 12/2007 | Gritelli et al. | |
| D558,555 | S | 1/2008 | Huang | |
| D571,180 | S | 6/2008 | Marshall | |
| D573,436 | S | 7/2008 | Wu | |
| D582,746 | S | 12/2008 | Neiser | |
| D592,034 | S | 5/2009 | Huang | |
| 7,533,595 | B2 | 5/2009 | Domenico | |
| D607,707 | S | 1/2010 | Huang | |
| 7,958,639 | B2 * | 6/2011 | Ireland | 30/2 |
| 8,671,578 | B1 * | 3/2014 | Frazer | 30/162 |
| 8,782,909 | B1 * | 7/2014 | Davis et al. | 30/280 |
| 8,875,406 | B2 * | 11/2014 | Collard et al. | 30/280 |
| 2002/0194734 | A1 * | 12/2002 | Huang | 30/2 |
| 2004/0244206 | A1 * | 12/2004 | Perlmutter et al. | 30/162 |
| 2007/0283570 | A1 * | 12/2007 | Huang | 30/162 |
| 2009/0255970 | A1 | 10/2009 | Volato | |
| 2012/0102758 | A1 * | 5/2012 | Lee | 30/159 |
| 2014/0013605 | A1 * | 1/2014 | Wu | 30/162 |
| 2014/0182140 | A1 * | 7/2014 | Rosenhan et al. | 30/162 |
| 2014/0250695 | A1 * | 9/2014 | Wagner et al. | 30/162 |
| 2014/0352156 | A1 * | 12/2014 | Landwehr | 30/162 |

OTHER PUBLICATIONS

Safecutting, Michigan Safety Products, www.safecutting.com, 2011.
Vanguard Technetics, Inc., SafetyKnife.com., 2011.
Spectrum Tools Catalog, Spectrum Tools, A Division of Pacific Handy Cutter, Inc., Costa Mesa, California, www.razortools.com, admitted prior art.
Betters Tools LLC Catalog, www.better-tools.com, 2003.
Allway Tools, Soft Grip Tools for Hard Hat Jobs, 2008.

* cited by examiner

FIG. 7
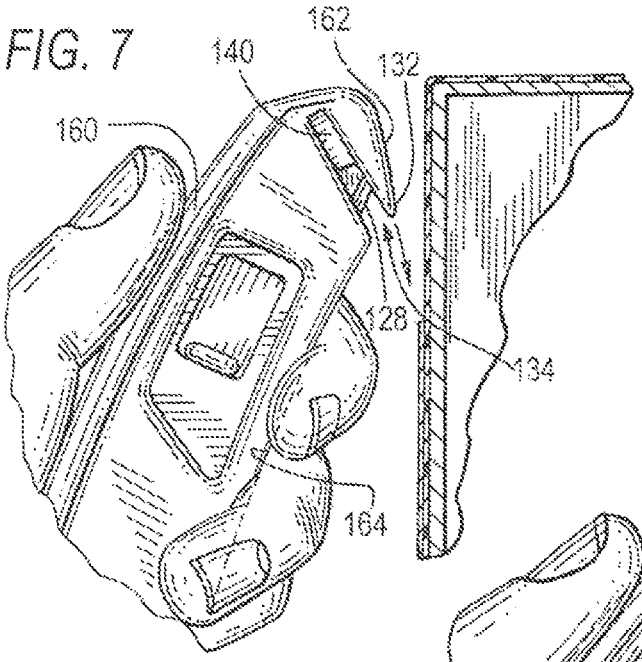
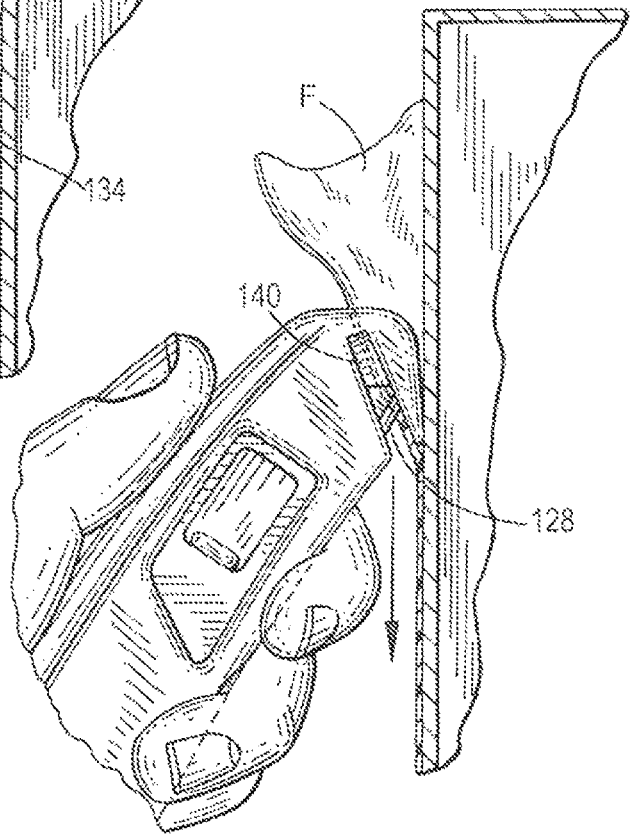
FIG. 8
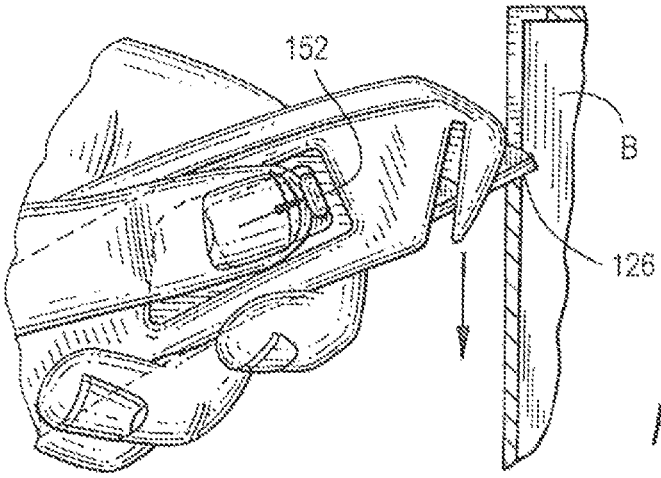
FIG. 9

FIG 12
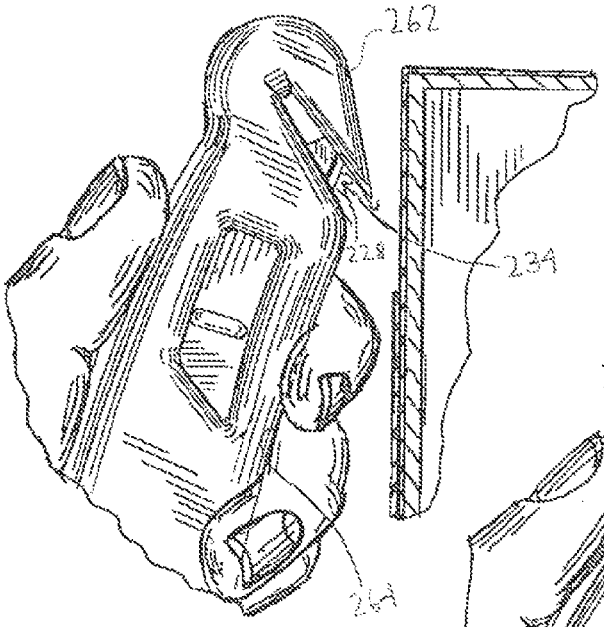
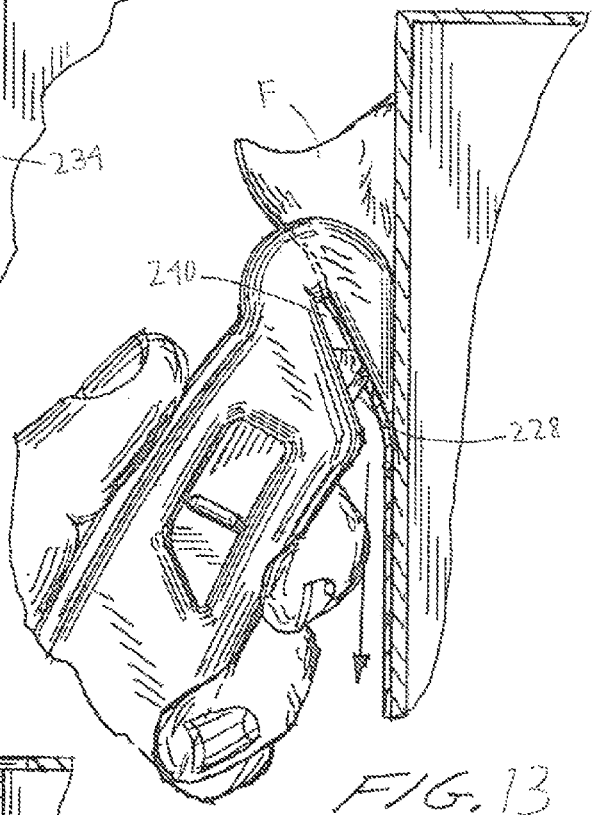
FIG. 13
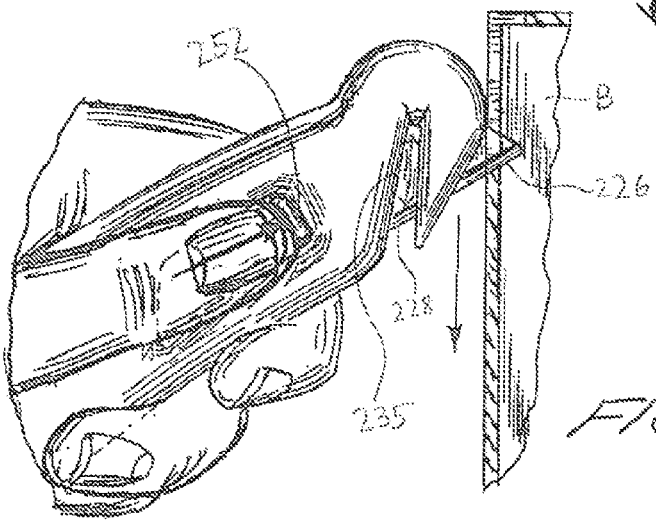
FIG. 14

MULTIFUNCTION SAFETY KNIFE

RELATED APPLICATIONS

This application is a continuation-in-part of U.S. patent application Ser. No. 13/468,868 filed on May 10, 2012 (pending), which is incorporated herein by reference.

FIELD OF THE INVENTION

This invention relates generally to the field of safety knives. More specifically, this invention involves a safety knife having a head designed to expose a bottom cutting edge of a blade in a protected position and, when engaged, to additionally expose a front cutting edge of the blade. The knife further includes a biasing member which urges the blade of the knife to the protected position.

BACKGROUND OF THE INVENTION

Safety knives generally include a blade having a first protected position and second extended cutting position. Safety knives such as the one disclosed in U.S. Pat. No. 6,832,438 include a spring urging the blade to the protected position. In the cutting position, the front of the blade with its blade edge extends beyond the knife's housing and may be used for cutting. Such a knife is very good for cutting and thus opening a box, but it is limited when it comes to cutting away a film wrapping from a package. If such a knife is used to cut film wrapping from a package, the blade may tend to damage the package.

Knives that are designed to remove film packaging without damaging the contents of the packaging tend to be limited in value when it comes to cutting a box. There is a need for a single knife that effectively serves both of these functions.

SUMMARY OF THE INVENTION

In view of the deficiencies and drawbacks in the prior art, it is a primary object of the present invention to provide an improved safety knife that may be used both to cut film wrapping without damaging the contents of the wrapping and to cut a box.

Another object of the present invention is to provide a knife that will minimize injuries to its users.

Additional objects of the present invention will be apparent from the description of the invention that follows.

In summary, there is provided in a preferred embodiment of the present invention a multifunction safety knife assembly comprising: a housing having a head and a body, the head including a frontal opening and a protected lower opening; a biasing element enclosed in the body, the biasing element attached at one end to the housing; a blade carrier attached to an opposite end of the biasing element, the blade carrier holding a blade having a front cutting edge and a bottom cutting edge, wherein the bottom cutting edge of the blade is exposed by the protected lower opening, and the front cutting edge of the blade is selectively exposed by the frontal opening; and a latch fixed to the blade carrier, the latch controlling the selective exposure of the front edge by the frontal opening.

BRIEF DESCRIPTION OF THE DRAWINGS

The above-described and other advantages and features of the present disclosure will be appreciated and understood by those skilled in the art from the following detailed description and drawings of which.

FIG. 8 is a side view of the first embodiment of the multifunction safety knife of the present invention, showing the knife cutting film using the bottom cutting edge of the blade through the protected lower opening of the head; and FIG. 9 is a side view of the first embodiment of the multifunction safety knife of the present invention, showing the knife cutting a box using the front cutting edge of the blade exposed through the frontal opening of the head.

FIG. 11 is a right side elevation view thereof;

FIG. 12 is a side view of the second embodiment of the multifunction safety knife of the present invention, showing the knife about to cut film using the bottom cutting edge of the blade through the protected lower opening of the head;

FIG. 13 is a side view of the second embodiment of the multifunction safety knife of the present invention, showing the knife cutting film using the bottom cutting edge of the blade through the protected lower opening of the head; and FIG. 14 is a side view of the second embodiment of the multifunction safety knife of the present invention, showing the knife cutting a box using the front cutting edge of the blade exposed through the frontal opening of the head.

DETAILED DESCRIPTION OF THE INVENTION

Figure 1:
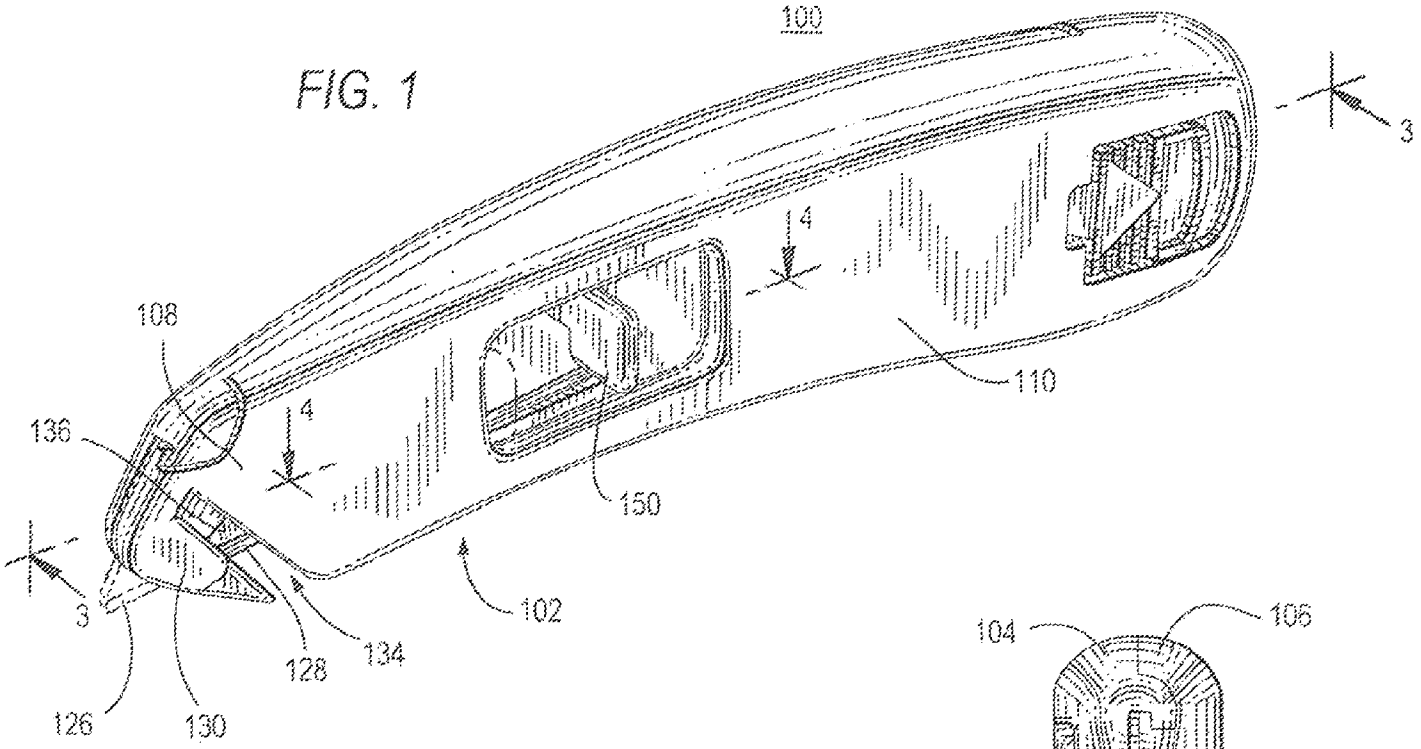
FIG. 1 is a front top left side perspective view of a the first embodiment of the multifunction safety knife of the present invention.

With reference to FIGS. 1 through 9, there is shown a first embodiment of a safety knife assembly 100 of the present invention. The Knife assembly 100 includes a housing 102 made up of a first portion 104 and a second portion 106. The first portion 104 and the second portion 106 comprise two attachable sides of the housing 102. The housing 102 further includes a head 108 and a body 110, where the head 108 is the front of the housing 102 and the body 110 is the rear of the housing 102. The body 110 is used as a handle for controlling the head 108.

Figure 3:
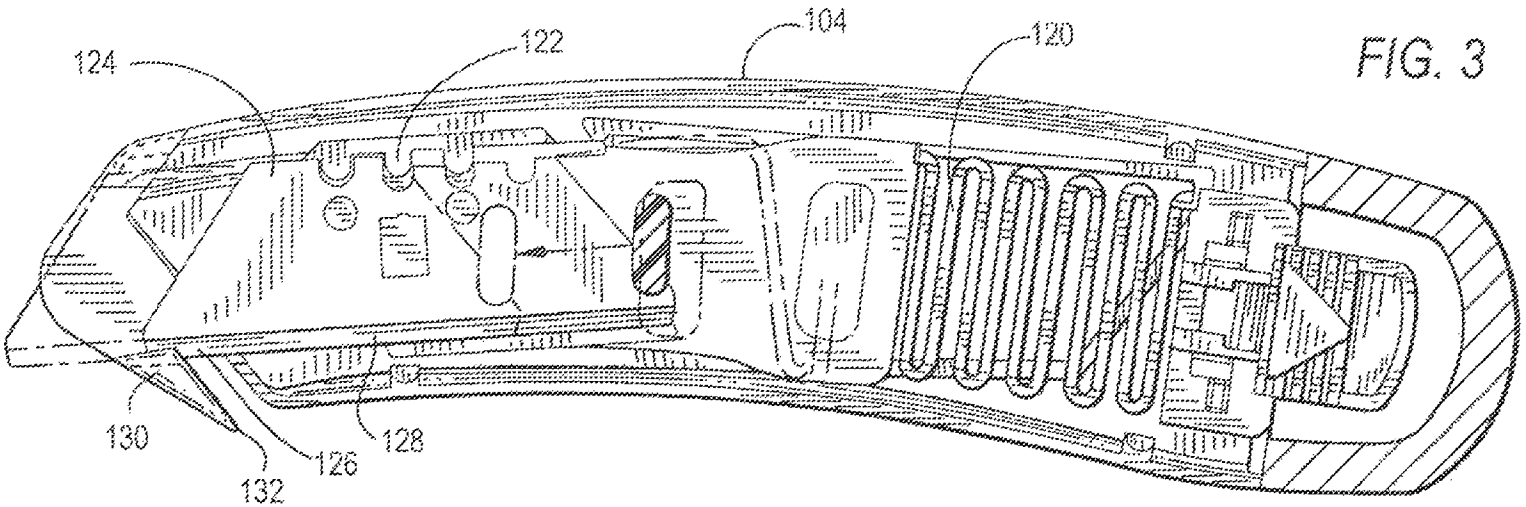
FIG. 3 is a cross section view thereof, taken along line 3-3 of FIG. 1.

As illustrated in the cross section view of FIG. 3, inside the housing 102 are a biasing element 120 and a blade carrier 122. The biasing element 120 is fixed to the housing 102 at one end and to the blade carrier 122 at its opposite end. The blade carrier 122 is designed to hold a blade 124 as shown in FIG. 3. The blade 124 is preferably a conventional replaceable trapezoid razor blade. The blade 124 includes a front cutting edge 126 and a bottom cutting edge 128. These edges 126, 128 are integral to and aligned along one edge of the blade 124 as shown in FIG. 3.

Referring back to FIG. 1, the head 108 of the safety knife assembly 100 is shown. The head 108 includes a hook 130 having a hook point 132. Adjacent to the hook point 132 towards the body is a channel 134 of preferably uniform width having a protected lower opening 136 where the blade bottom cutting edge 128 is exposed. The channel 134 is sized and configured to prevent a finger from entering the channel 134 and contacting the blade bottom cutting edge 128. The axis of the channel 134 is preferably at an angle of approximately sixty degrees relative to the cutting edges 126, 128.

Figure 2:
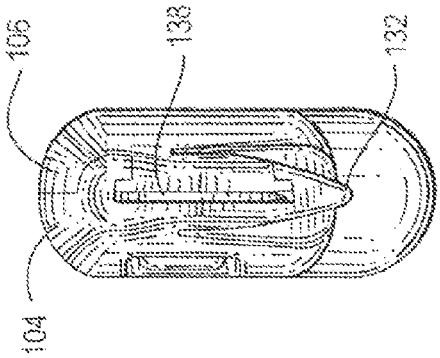
FIG. 2 is a front elevation view thereof.

Additionally, and as best shown in FIG. 2, the head 108 includes a frontal opening 138. The frontal opening 138 allows the blade front cutting edge 126, when activated, to extend out from the head 108 as discussed below. In the preferred embodiment, the frontal opening 138 is marginally wider than the blade 124 in area.

Figure 4:
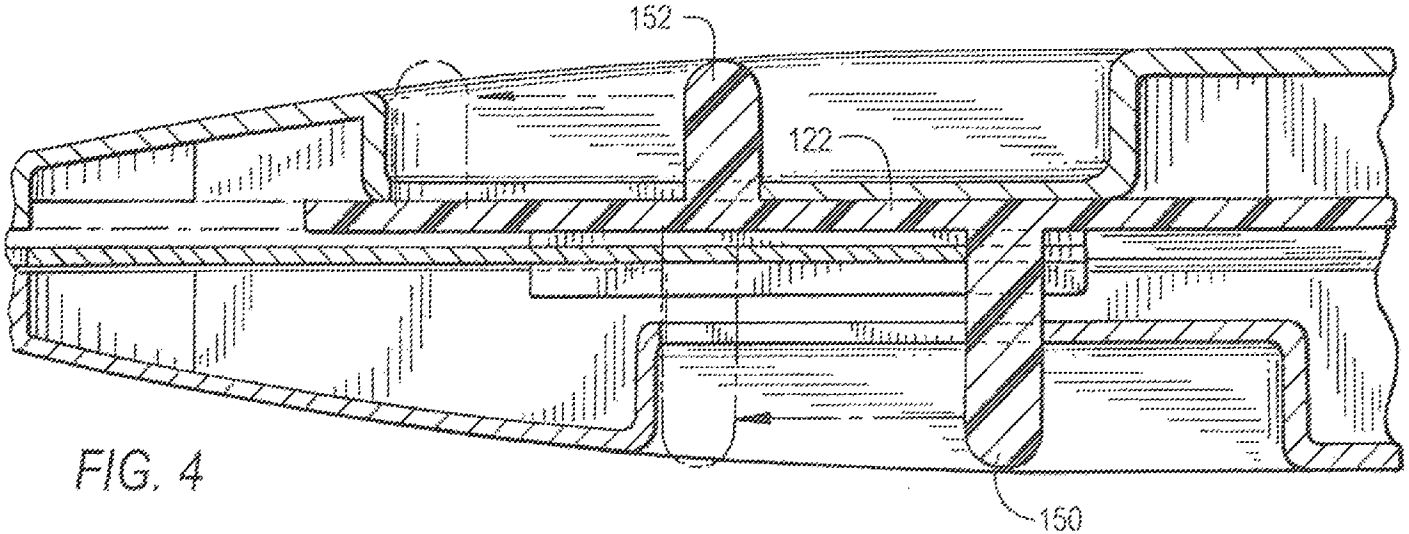
FIG. 4 is a partial cross section view thereof, taken along line 4-4 of FIG. 1.
Figure 5:
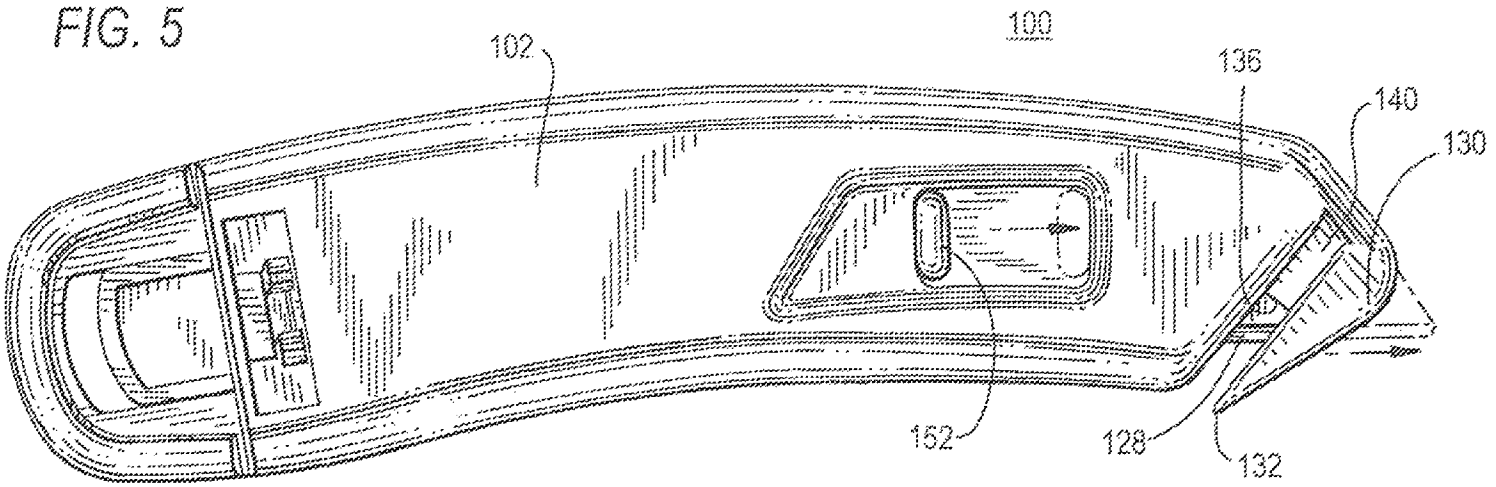
FIG. 5 is a right side elevation view thereof.

Returning to the interior of the safety knife assembly 100, FIG. 3 in combination with FIGS. 4 and 5, show how the blade 124 can be moved from a first recessed position to a second extended position. As shown in FIG. 4, the safety knife assembly 100 further includes a first latch 150 and a second latch 152, for alternate hand use. Both the first latch 150 and the second latch 152 are fixed to the blade carrier 122. Accordingly, when a forward force is applied to either latch 150, 152 (such as by a user's thumb as shown in FIG. 9), the biasing element 120 is expanded and the blade carrier 122 is moved forward causing the blade front cutting edge 126 to extend out from the head 108 through the frontal opening 138.

Figure 7:
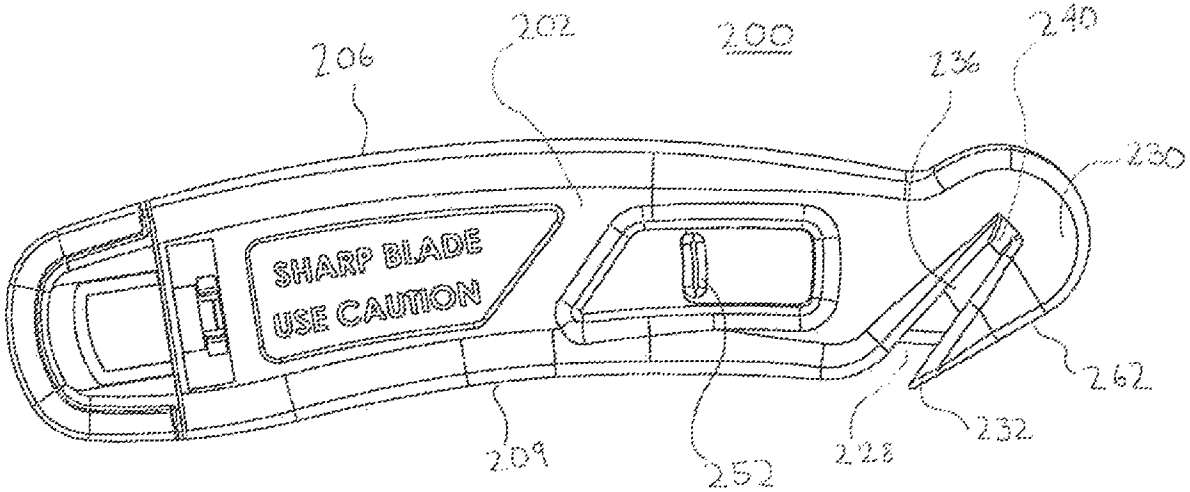
FIG. 7 is a side view of the first embodiment of the multifunction safety knife of the present invention, showing the knife about to cut film using the bottom cutting edge of the blade through the protected lower opening of the head.

As illustrated in FIGS. 7 through 9, the safety knife assembly 100 is designed for two distinct cutting operations. FIGS. 7 and 8 show the safety knife assembly 100 with the blade 124 in the first recessed position. A left handed user may hold the knife assembly 100 with the user's left thumb pressing against the top 160 of the knife assembly 100 and the user's fingers wrapping around the bottom 164 of the knife assembly 100 such that the hook point 132 is directed downward. Here, the blade bottom cutting edge 128 is exposed, the front of the head 162 is facing forward, and the blade front cutting edge 126 is enclosed within the head 108.

With the blade 124 in the first recessed position, the safety knife assembly 100 may be used to cut through a film F or plastic wrapping while preventing or minimizing interaction with a box B or other material underneath the film F. Plastic wrappings of the type anticipated by the present invention are commonly used for security purposes and to prevent damage to the wrapped package. In particular, the hook point 132 may be used to puncture the film F and lift the film F away from box B so that the blade bottom cutting edge 128 may cut through a length of film F. (See FIG. 7 and the preferably approximately sixty degree angle between the channel 134 and the blade bottom cutting edge 128.) During cutting, the front of the head 162 may be in contact with the box B and is configured to slide along a length of the box B. Additionally, the head 108 includes channel indents 140 that minimize any resistance caused by the cut film F as the knife assembly 100 cuts through the length of film F.

In addition to cutting film F, the knife assembly 100 is very effective at cutting plastic straps often used to secure a box or to secure multiple boxes together. In order to cut a strap, the hook point 132 digs under the strap and pulls the strap up, allowing the blade bottom cutting edge 128 to cut through the strap.

FIG. 9 shows the knife assembly 100 in the second extended position in which the blade front cutting edge 126 is extended for cutting into a box B. Here, a user's left thumb is pressing the second latch 152 forward while the user's fingers wrap around the body 110 of the knife assembly 100. The forward force on the latch 152 extends the blade front cutting edge 126 out the frontal opening 138. With the blade front edge 126 extended out from the head 108, the blade 124 can be used to cut into a box B as shown in FIG. 9. Of note, FIG. 9 illustrates a preferably slightly less than ninety degree angle between the blade bottom cutting edge 128 and the box B.

As illustrated in the drawings, the front of the head 162 is slanted at an approximately forty-five degree angle relative to the length of the knife assembly 100 with the hook point 132 aiming rearward towards the body 110. The slant provides at least two benefits. First, the slant enables the user to hold the knife assembly 100 in a comfortable position when cutting film F with the blade 124 in the first recessed position. Second, the slant allows a greater length of the blade front cutting edge 126 to extend from the frontal opening 138 when the blade is moved to the second extended position. Accordingly, more of the blade 124 is available for cutting a box.

An additional benefit of the knife assembly 100 is that it distributes wear over two different sections of the blade 124—front cutting edge 126 and bottom cutting edge 128. It is known that even the most durable razor blades experience wear and loss of sharpness due to normal use. In contrast to single position knives, the two different cutting positions of the knife assembly 100 rely on different sections (126 and 128) of the blade 124. Accordingly, while one section (126 or 128) of blade 124 is being used, the other section (126 or 128) is relieved from wear and loss of sharpness.

With reference to FIGS. 10 through 14, there is shown a second embodiment of the safety knife assembly 200 of the present invention. The knife assembly 200 includes a housing 202 made up of a first portion 204 and a second portion 206. The first portion 204 and the second portion 206 comprise two attachable sides of the housing 202. The housing 202 further includes a head 208 and a body 210, where the head 208 is the front of the housing 202 and the body 210 is the rear of the housing 202. The body 210 is used as a handle for controlling the head 208.

The internal structure of the assembly 200 is consistent with the internal structure of the assembly 100, as shown in FIG. 3. The second embodiment of the safety knife assembly 200 includes a biasing element 120 and a blade carrier 122 in the housing 202. The biasing element 120 is fixed to the housing 202 at one end and to the blade carrier 122 at its opposite end. The blade carrier 122 is designed to hold a blade 124 as shown in FIG. 3. The blade 124 (224 in FIGS. 10-14) is preferably a conventional replaceable trapezoid razor blade. The blade 224 includes a front cutting edge 226 and a bottom cutting edge. These edges 226, 228 are integral to and aligned along one edge of the blade 224.

Figure 10:
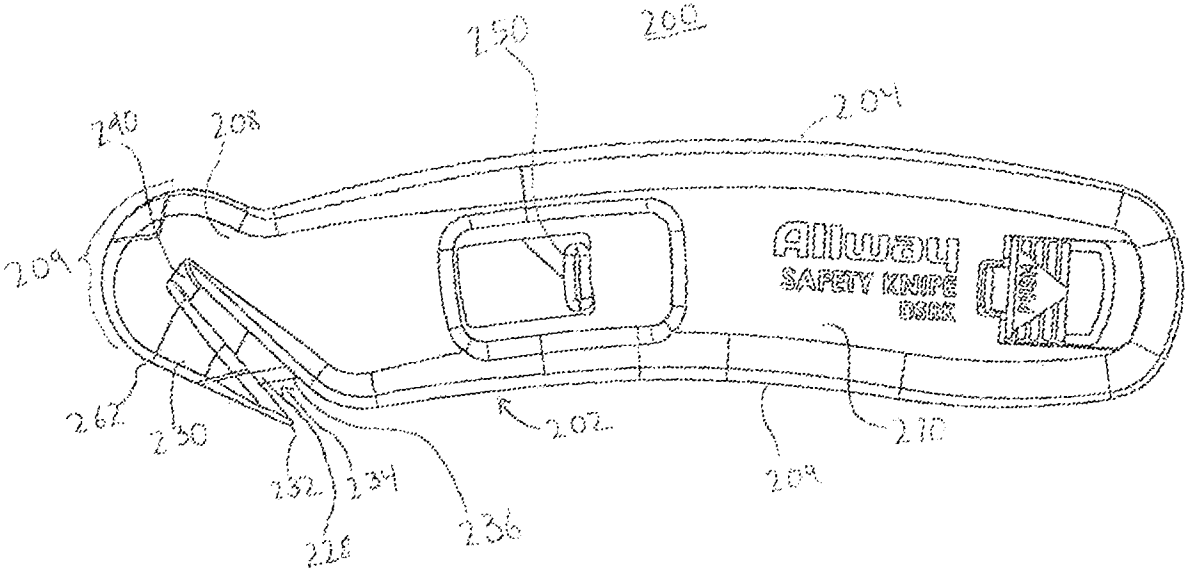
FIG. 10 is a left side elevation view of a second embodiment of the multifunction safety knife of the present invention.

Referring to FIG. 10, the head 208 of the safety knife assembly 200 is shown. The head 208 includes a hook 230 having a hook point 232. Adjacent to the hook point 232 is a channel 234 having a protected lower opening 236 where the blade bottom cutting edge 228 is exposed. The channel 234 is preferably at an angle of approximately sixty degrees relative to the cutting edges 226, 228. In the second embodiment, the channel 234 is significantly longer than the channel 134 of the first embodiment. The extension of the channel 234 allows for more of the blade 224 to be exposed when the blade 224 is in the forward cutting position. In particular, when cutting hard plastic straps commonly used to wrap large packages, there is clearance between the rear 240 of the channel 234 and the strapping. This clearance allows the strapping to be cleanly cut without interference from the rear 240 of the channel 234. Preferably, the entire height 235 of blade 224 is exposed in channel 234, as illustrated in FIG. 14.

In order to provide the elongated channel 234 without decreasing the strength of head 208, head 208 is made taller than head 108 to provide increased clearance before a material being cut reaches rear 240. In the second embodiment, assembly 200 includes a curvature 209 that provides increased structural stability, especially when the assembly 200 is used to cut film as illustrated in FIGS. 12 and 13.

In a third embodiment, head 208 is reinforced by additional material for further strength. The reinforcement may include thicker material or an additional material located inside or outside the assembly 200.

Figure 6:
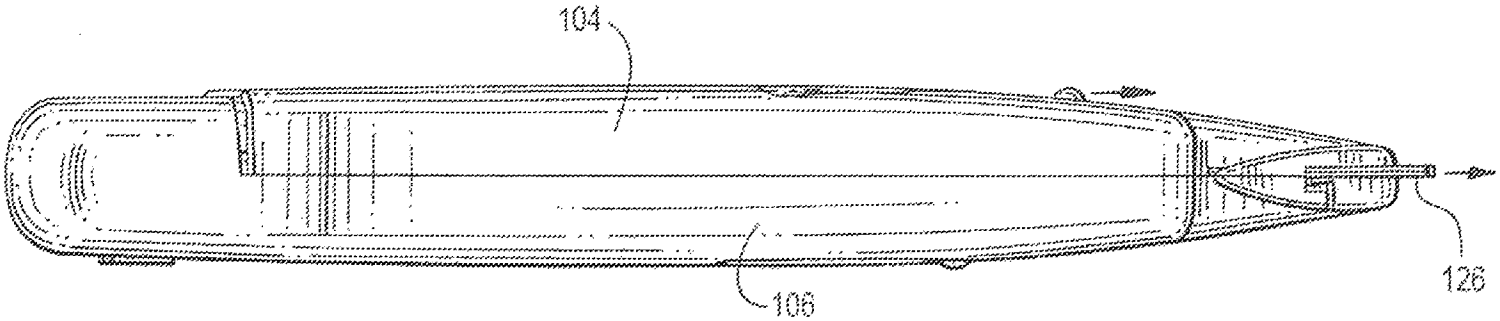
FIG. 6 is a bottom plan view thereof.

As illustrated in FIGS. 10 and 11, the second embodiment has a rounded head 208 that forms a flat surface 262 which enables the hook point 232 to fit underneath plastic wrapping or film. As shown in FIG. 6, the hook point 232 tapers in a cylindrical manner towards a point 232, which is ideal for fitting underneath plastic wrapping or film.

The accompanying drawings only illustrate several embodiments of a safety knife and its respective constituent parts, however, other types and styles are possible, and the drawings are not intended to be limiting in that regard. Thus, although the description above and accompanying drawings contains much specificity, the details provided should not be construed as limiting the scope of the embodiments but merely as providing illustrations of some of the presently preferred embodiments. The drawings and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A multifunction safety knife assembly, including a blade, comprising:

a housing having a head and a body, the head including a frontal opening and a lower protected opening, the lower protected opening including a lower section adapted to expose the blade;

a channel, having a first end and a second end, defined at the first end by the lower protected opening, where the second end is positioned in the head of the assembly to allow length of the channel to expose the full height of the blade while maintaining structural stability of the head;

a biasing element enclosed in the body, the biasing element attached at one end to the housing;

a blade carrier attached to an opposite end of the biasing element, the blade carrier holding the blade, the blade having a front cutting edge and a bottom cutting edge, wherein the bottom cutting edge of the blade is exposed by the protected lower opening, and the front cutting edge of the blade is selectively exposed by the frontal opening; and a first element fixed to the blade carrier, the first element controlling the selective exposure of the front edge of the blade by the frontal opening;

wherein the blade is positioned in the lower section of the lower protected opening when the front cutting edge of the blade is not exposed by the frontal opening and the blade is positioned in both the lower section and the upper section of the lower protected opening when the front cutting edge of the blade is exposed by the frontal opening wherein the biasing element is adapted to urge the blade between a first position where the bottom cutting edge of the blade is exposed and the front cutting edge of the blade is enclosed, and a second position where both the front cutting edge and the bottom cutting edge of the blade are exposed.

2. The multifunction safety knife assembly of claim 1, wherein the head is in the shape of a hook.

3. The multifunction safety knife assembly of claim 1, wherein the head includes a rearward facing point.

4. The multifunction safety knife assembly of claim 1, further comprising a second latch fixed to the blade carrier.

5. The multifunction safety knife assembly of claim 1, wherein the frontal opening is marginally wider than the blade.

6. The multifunction safety knife assembly of claim 1, wherein the head includes a front surface being offset from the length of the knife by approximately forty-five degrees.

7. The multifunction safety knife assembly of claim 1, wherein the protected lower opening is adapted to prevent a finger from contacting the bottom edge of the blade.

8. The multifunction safety knife assembly of claim 1, wherein the rearward facing point forms a front of the head having an approximately forty-five degree angle relative to the length of the knife assembly.

9. The multifunction safety knife assembly of claim 1, wherein the head includes channel indents adapted to minimize resistance caused by cut film.

10. The multifunction safety knife assembly of claim 1, wherein the blade experiences wear to the front cutting edge when used in the first position and experiences wear to the bottom cutting edge when used in the second position.

11. A multifunction safety knife assembly comprising:

a housing having a head and a body;

a biasing element fixed to the housing at one end and a blade carrier at its opposite end, the blade carrier securing a blade; and a head having a hook point, wherein the hook point is adjacent to a channel having a lower opening where a cutting edge of the blade is exposed;

wherein the channel is sized and shaped to provide exposure of substantially all of the height of the blade wherein the biasing element is adapted to urge the blade between a first position where the bottom cutting edge of the blade is exposed and the front cutting edge of the blade is enclosed by said hook point, and a second position where both the front cutting edge and the bottom cutting edge of the blade are exposed.

12. The multifunction safety knife assembly of claim 11, wherein the head is reinforced by additional material for further strength.

13. The multifunction safety knife assembly of claim 11, wherein the body has a curvature that provides increased structural stability when used to cut film.

14. The multifunction safety knife assembly of claim 11, wherein the head is rounded creating a flat surface enabling the hook point to fit underneath plastic film or wrapping.

* * * * *